US009805632B2

(12) United States Patent
Frost

(10) Patent No.: US 9,805,632 B2
(45) Date of Patent: Oct. 31, 2017

(54) TRAILER HITCH LIGHTED DISPLAY WITH INTEGRAL STEP

(76) Inventor: James Randall Frost, Gainesville, GA (US)

( * ) Notice: Subject to any disclaimer, the term of this patent is extended or adjusted under 35 U.S.C. 154(b) by 29 days.

(21) Appl. No.: 13/007,596

(22) Filed: Jan. 14, 2011

(65) Prior Publication Data

US 2011/0167688 A1 Jul. 14, 2011

Related U.S. Application Data

(60) Provisional application No. 61/294,940, filed on Jan. 14, 2010.

(51) Int. Cl.
*G09F 21/00* (2006.01)
*G09F 21/04* (2006.01)

(52) U.S. Cl.
CPC ..... *G09F 21/04* (2013.01)

(58) Field of Classification Search
CPC ..... G09F 21/04; G09F 13/14; B60R 13/00; B60R 13/10; B60R 13/105; B60R 3/007; B60Q 1/56; B60Q 1/2615
See application file for complete search history.

(56) References Cited

U.S. PATENT DOCUMENTS 2,622,356 A * 12/1952 Valente ..... 40/206
5,214,870 A * 6/1993 Cohen ..... G09F 13/06 40/575
D370,452 S * 6/1996 Beasley ..... D12/203
5,825,281 A * 10/1998 McCreary ..... B60Q 1/2611 340/425.5
5,979,094 A * 11/1999 Brafford, Jr. ..... 40/590
6,412,202 B1 * 7/2002 Oswood ..... 40/591
D464,919 S * 10/2002 Pichan ..... D12/162
(Continued)

*Primary Examiner* — Cassandra Davis
(74) *Attorney, Agent, or Firm* — Mayback & Hoffman, P.A.; Gregory L. Mayback

(57) ABSTRACT

A lighted display for mounting upon a vehicle having a trailer hitch receiver. The lighted display includes an elongated base member with a trailer hitch mount affixed midway along the base member. The base member also incorporates a horizontal step plate extending outward from upper edge of the base member allowing easier access to the rear of the vehicle. The base member is configured to receive multiple lighting elements within an elongated vertical channel. The lighting elements are connected to a trailer wiring plug which is configured to engage the vehicles trailer wiring connector. A message board is positioned within the vertical channel of the base member. The message board is made of a semi-translucent material which allows a portion of the light from the lighting elements to pass. The message board is partially masked with an opaque material, the unmasked portions forming the desired message for display. Upon illumination of the vehicle driving lights, one or more of the lighting elements are illuminated at the low light intensity level. Upon illumination of the vehicle brake light, one or more of the lighting elements are illuminated at the high light intensity level. And upon illumination of the vehicle turn signal light one or more of the lighting elements are illuminated at the high light intensity level in coordination with and on the corresponding side of the vehicle as the vehicle turn signal light.

15 Claims, 11 Drawing Sheets

(56) References Cited

U.S. PATENT DOCUMENTS

| | | | | |
|---|---|---|---|---|
| 6,491,315 | B2 * | 12/2002 | Hagen | B60Q 1/2661 224/527 |
| 6,553,697 | B1 * | 4/2003 | Pichan | 40/591 |
| 7,635,247 | B2 * | 12/2009 | Collins | B60R 3/02 414/462 |
| 2005/0286257 | A1 * | 12/2005 | Trimmer | B60Q 1/50 362/485 |
| 2007/0118423 | A1 * | 5/2007 | Always | 705/14 |
| 2012/0320620 | A1 * | 12/2012 | Bosarge | B60Q 1/2661 362/546 |

* cited by examiner

TRAILER HITCH LIGHTED DISPLAY WITH INTEGRAL STEP

CROSS-REFERENCE TO RELATED APPLICATION

This application claims the benefit of U.S. Provisional Application Ser. No. 61/294,940, filed on Jan. 14, 2010, the entirety of which is hereby incorporated herein by reference.

BACKGROUND OF THE INVENTION

1. Field of the Invention

The present invention generally relates to lighted accessories for use on vehicles. More particularly, the present invention relates to a lighted display with integral step for mounting upon a vehicle receiver hitch.

2. Description of the Related Art

Consumers are always looking for new fun specialty products that allow them to share their interests, hobbies and opinions with others. While key chains, coffee mugs or conventional bumper stickers appear on the market toting various slogans, company insignia or sports team associations, there is nothing for vehicle owners that lights up to really create an eye catching look.

Personal business or commercial vehicles are often adorned with Company names and contact information upon the sides of the vehicle. Such advertisements are often in the form of stickers which are not easily removed or changed. The advertisements may also be more permanent in the form of painted graphics. The messages and advertisements are also not easily changed or customized to a current opportunity, location, or business venture. The problem with messages or advertisements on the side of vehicles is that, for the majority of time, other motorists are looking at the rear of other vehicles.

The most effective messages or advertisements are lighted displays. Lighted displays catch the eye of the viewer readily and are a clear step above the common bumper sticker. Lighted displays may also be used to enhance the visibility and safety of the vehicle. The vehicle driving lights, brake lights, and turn signals may all benefit in operation from additional light emphasis.

Many vehicles include a receiver style trailer hitch. The vehicle receiver hitch is firmly mounted to the vehicle frame and is configured to receive one end of a square trailer hitch mount within the receiver body. The trailer hitch mount is then pinned within the hitch receiver to provide a strong connection. A properly sized hitch ball is then bolted to the other end of the hitch mount to allow towing of trailers or boats. Many vehicles which incorporate a receiver style trailer hitch lack a convenient step for accessing the rear cargo area of the vehicle. The trailer hitch mount is sometimes used, but the narrow bar of the hitch mount does not present an ideal or safe footing for a person attempting to access the cargo area. Vehicles equipped with a receiver hitch mount also typically have a trailer electrical wiring connector. The connectors are of a partially standardized design and allow a range of trailer electrical plugs to engage and draw electrical power from the vehicle. Therefore at the rear of many vehicles, a location to mount a device and a source for electrical connection to the vehicle is readily provided.

According, what is needed in the art is a device to allow for the presentation of lighted personal or ornamental messages upon the rear of a vehicle. The message can be in text form or may also contain stylized graphics or logos. The device should be simple to install upon a vehicle equipped with a trailer receiver hitch and a trailer lighting connector. The message displayed on the lighted display should be readily changed by the operator. The device should also work in coordination with the vehicle driving lights, braking lights, and turn signals to enhance the visibility of each of the lighting systems and thus enhance vehicle operation safety. The device should also provide a convenient step for ready access into the rear of the vehicle by the operator and be adjustable for different size and styles vehicles. It is thus to such a trailer hitch lighted display with integral step that the present invention is primarily directed.

SUMMARY OF THE INVENTION

The disadvantages of the prior art are overcome by the present invention which, in one aspect, is a lighted display for use upon a vehicle. The vehicle has at least one driving light at the front of the vehicle, at least one brake light at the rear of the vehicle, and at least one turn signal light on each side of the rear of the vehicle. The vehicle also has a trailer hitch receiver for receiving a trailer hitch mount therein, and a trailer electrical wiring connector for receiving a trailer wiring plug.

The lighted display includes an elongated base member forming a vertical channel extending the length of the base member. The base member is formed by an aluminum extrusion and includes a horizontal step plate surface extending outward from the vertical channel. A trailer hitch mount is affixed midway upon the elongated base member. A plurality of lighting elements snap within the elongated vertical channel of the base member and are in electrical contact with a trailer wiring plug. Each lighting elements is able to be illuminated at a high light intensity level, and a low light intensity level. Each lighting element includes a base with electrical connector and a light bulb.

In another aspect, a message board is positioned within the elongated vertical channel of the base member. The message board is made from a semi-translucent material. Portions of the message board are covered by a substantially opaque material, the uncovered portion of the message board forming the desired message for display. The opaque material covering the message board is made of an adhesive backed membrane such as vinyl sheet. In another aspect of the present invention, the opaque material covering the message board is formed from multiple adhesive backed peel and stick membranes, each membrane comprising an opening in the shape of an alphabetical or numerical character. The vehicle owner arranges the characters upon the message board to form a desired message.

In use, the hitch mount is inserted within the vehicle hitch receiver of the vehicle and the wiring plug is inserted within the vehicle wiring connector. Upon illumination of the vehicle driving light, at least one of the lighting elements is illuminated at a low light intensity level. Upon illumination of the vehicle brake light, all of the lighting elements are illuminated at the high light intensity level. Upon illumination of the vehicle turn signal light at least one lighting element is illuminated at the high light intensity level in coordination with and on the corresponding side of the vehicle as the vehicle turn signal light.

In another aspect of the present invention, when the hitch mount is received within the hitch receiver of the vehicle the horizontal step plate of the base member forms a step for access to the vehicle. The base member and step plate may be oriented in one of two positions, placing the step plate at a lower of higher position relative to the vehicle body.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The trailer hitch lighted display device allows for the presentation of an ornamental message on the rear of a vehicle. The message may be in text form or may also contain stylized graphics or logos. The message displayed on the lighted display may be readily changed by the operator. The device works in coordination with the vehicle driving lights, braking lights, and turn signals to enhance the visibility of each of the lighting systems. The device also provides a convenient step for ready access into the rear of the vehicle by the operator.

Figure 1:
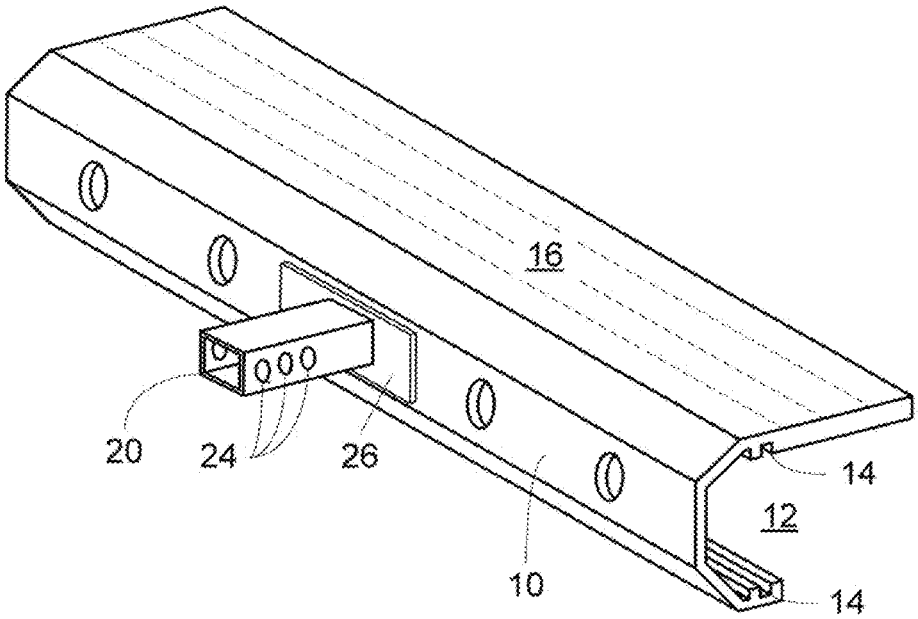
FIG. 1 is a rear side-perspective view showing the base member and trailer hitch mount of the device.

With reference to the figures in which like numerals represent like elements throughout, FIG. 1 is a side perspective view of one embodiment of the lighted display device. As depicted in FIG. 1, the lighted display has a base member 10 which forms a vertical channel 12. At the top and bottom of the vertical channel 12, guide slots 14 are present. At the top of the base member 10 a step plate section 16 extends horizontally outward. A trailer hitch mount 20 is affixed to the midsection of the base member 10. The trailer hitch mount 20 is configured to be received within the trailer hitch receiver of a vehicle. The hitch mount 20 is maintained within the vehicle hitch receiver by a pin as is commonly known by those skilled in the art. Multiple pin holes 24 are provided within the hitch mount 20 to allow optimal positioning of the device, closer to or farther away from the rear of the vehicle, as required by varying vehicle body styles. A flange 26 is provided at one end of the hitch mount 20 to facilitate attachment to the base member 10. The hitch mount 20 and flange 26 are formed from steel and are welded together using common welding practices known in the art. As may be appreciated by those skilled in the art, the hitch mount and flange may be made from any other durable, strong and weather resistant material.

As further depicted in FIG. 1, the base member 10 with the integral vertical channel 12, guide slots 14, and step plate 16 is formed as a single extrusion. The extrusion process allows for the incorporation of multiple features within the base member 10 in a cost effective manner. The base member 10 is made from extruded aluminum providing a strong and weather resistant body. In alternative embodiments, the base member may be made from a plastic or resin. The hitch mount flange 26 is affixed to the base member 10 using mechanical fasteners. Other means may be used to affix the hitch mount flange to the base member such as bonding, pinning, or welding as are known to those skilled in the art.

Figure 2:
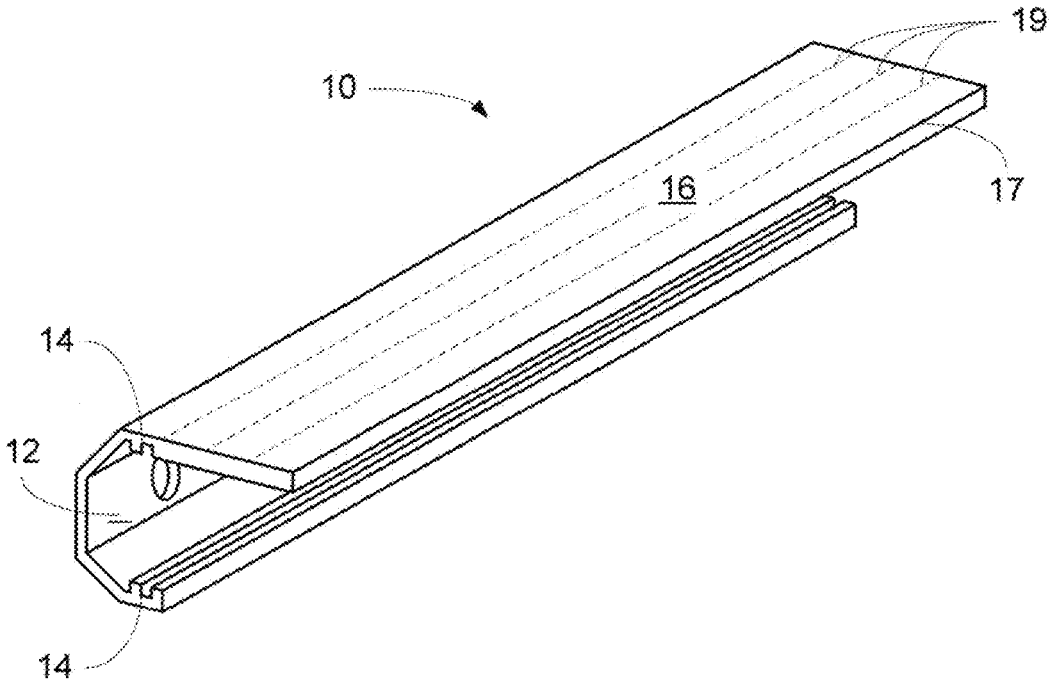
FIG. 2 is a front side-perspective view showing the base member of the device.

As depicted in FIG. 2, the base member 10 is an elongated C cross-sectional shape with an integral step plate section 16 extending horizontally out from the upper portion of the C cross-section. A vertically oriented channel 12 is formed by the C cross-sectional shape. Guide slots 14 are present within the upper and lower inner surfaces of the vertical channel 12. The upper surface 17 of the step plate section 16 has serrations or ribs formed into the aluminum extrusion. The ribs or serrations provide a durable, non-slip surface upon the top of the step and are depicted in FIG. 2 as dashed lines 19.

In an alternative embodiment of the present invention, the base member 10 may be assembled from multiple pieces. In one embodiment, an aluminum extrusion may form the step plate 16 and be affixed the hitch mount 20. The vertical channel 12 and guide slots 14 may be formed in a second extrusion in another material and affixed to the step plate 16, or hitch mount 20, or both. The second extrusion may be formed in plastic, aluminum, or other material as is known to those skilled in the art.

Figure 3:
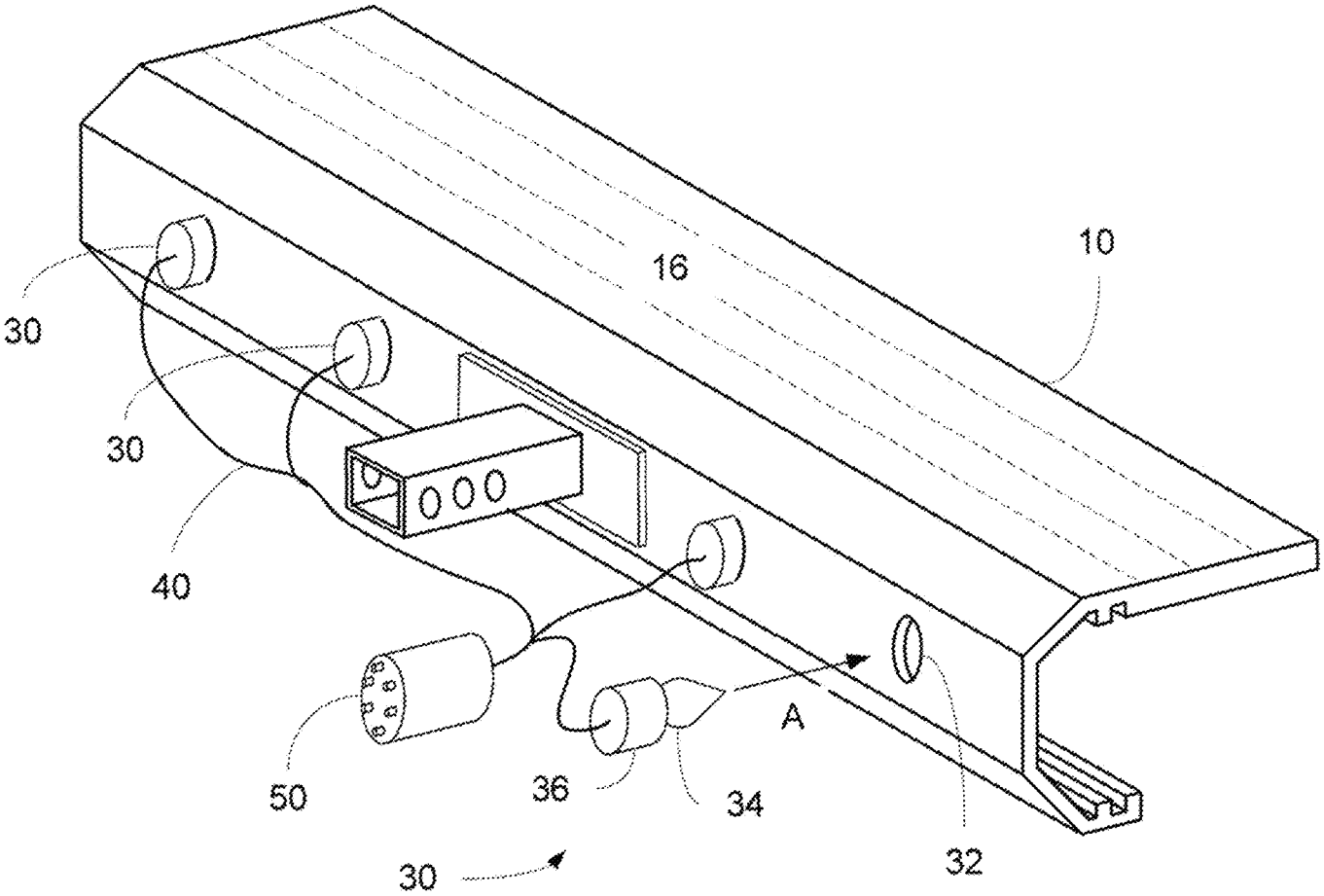
FIG. 3 is a rear side-perspective view showing the base member, trailer hitch mount, and installation of lighting elements.

As depicted in FIG. 3, the base member 10 has multiple holes 32 formed into the face of the vertical channel 12. Each hole 32 is configured to receive a lighting assembly 30. Each lighting assembly 30 includes a lighting element, in the form of a light bulb 34 and a plastic base 36. The plastic base 36 is inserted into the base member 10 in the direction of "Arrow A" and snaps within and is retained in the hole 32 in the base member 10. Each lighting assembly 30 is electrically connected to a wiring harness 40. The wiring harness is electrically connected to a trailer wiring plug 50. The trailer wiring plug 50 is configured to be received within the trailer wiring connector as is common on vehicles equipped with trailer hitch receivers. Upon mating of the wiring plug with the trailer wiring connector, the lighting elements of the device are in electrical connection with the vehicle lighting circuits.

Figure 4:
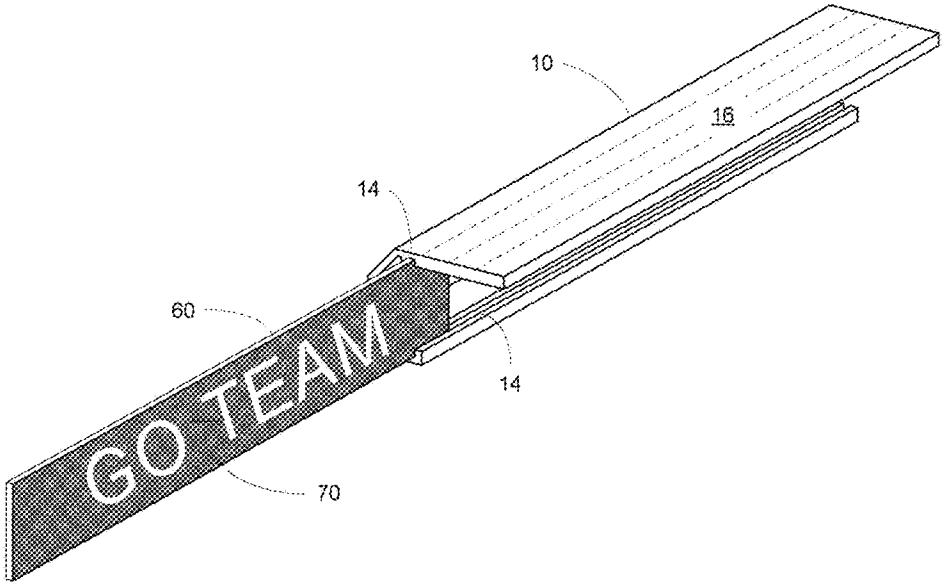
FIG. 4 is a front side-perspective view showing the base member and installation of a message board with message mask material applied.

As depicted in FIG. 4, a message board 60 may be positioned within the guide slots 14 of the base member 10. The message board 60 is rectangular in shape and made from red tinted acrylic sheet. The acrylic sheet is semi-translucent and light shining through the message board will be colored red by the tinted acrylic. A mask material 70 is applied to one surface of the acrylic sheet. The mask material 70 is opaque and does not allow light to pass through. A message may be displayed upon the message board by removing portions of the opaque mask material. The message may be formed from any shape which may be cut out of the opaque material including letters, numbers, or stylized symbols. In the depiction of FIG. 4, "GO TEAM" is displayed upon the message board. As will be appreciated by those skilled in the art, the message board may be made from other tinted or un-tinted plastics or resins.

As further depicted in FIG. 4, the mask material 70 is applied to the message board 60 as a single sheet with the desired message pre-cut and the unwanted mask material removed. The mask material 70 is an adhesive backed vinyl sheet. The desired message is easily cut into the sheet vinyl material using computer controlled automated label printers as are known in the art. The low cost of the adhesive backed vinyl and the use of automated label cutters allow the simple incorporation of any desired message upon the message board. As will be appreciated by those skilled in the art, the mask material 70 may be made from other opaque or semi-opaque plastic or resin sheet materials, and may be adhered to the message board using adhesives, bonding agents, heat fusion, or chemical fusion techniques.

In one embodiment of the present invention, the mask material 70 may be supplied pre-printed with the lighting display device. The vehicle owner selects which message is desired from the supplied messages and applies that mask material 70 containing the message to the message board 60. In another alternative embodiment of the present invention, pre-cut alphabetic, numeric, and stylized characters may be supplied with the lighting device as individual peel and stick portions of mask material 70. The vehicle owner may then design his or her own message by applying the mask material characters 70 in the required sequence to the message board 60. As will be appreciated by those skilled in the art, multiple sheets of pre-printed vinyl characters may be supplied with the lighting display device for a minimal cost. Highly stylized mask material designs may be designed and cut using the automated label machines.

Figure 5A:
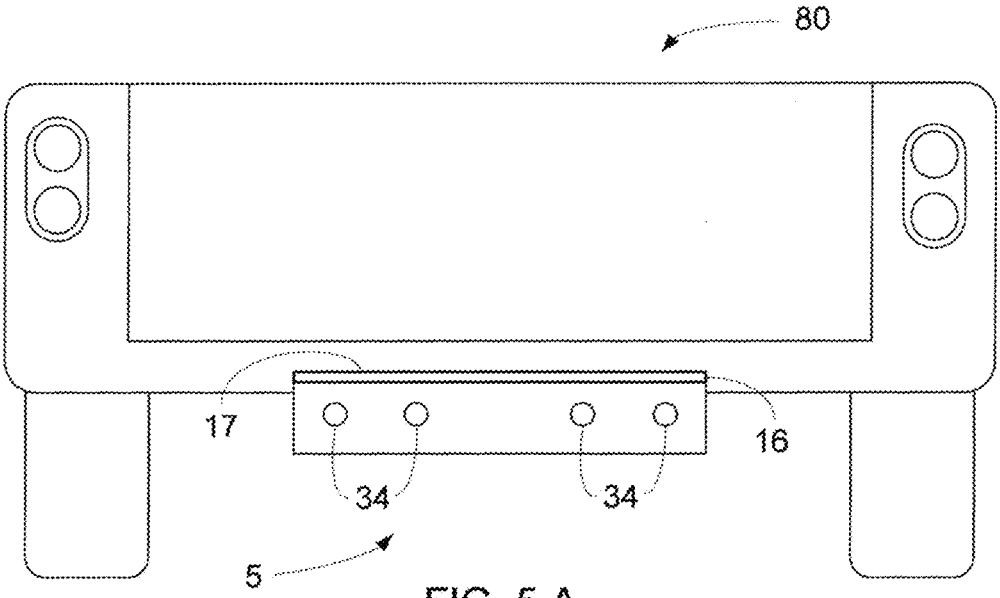
FIG. 5A is a rear view of a vehicle showing installation of the base member and lighting elements of the device.
Figure 5B:
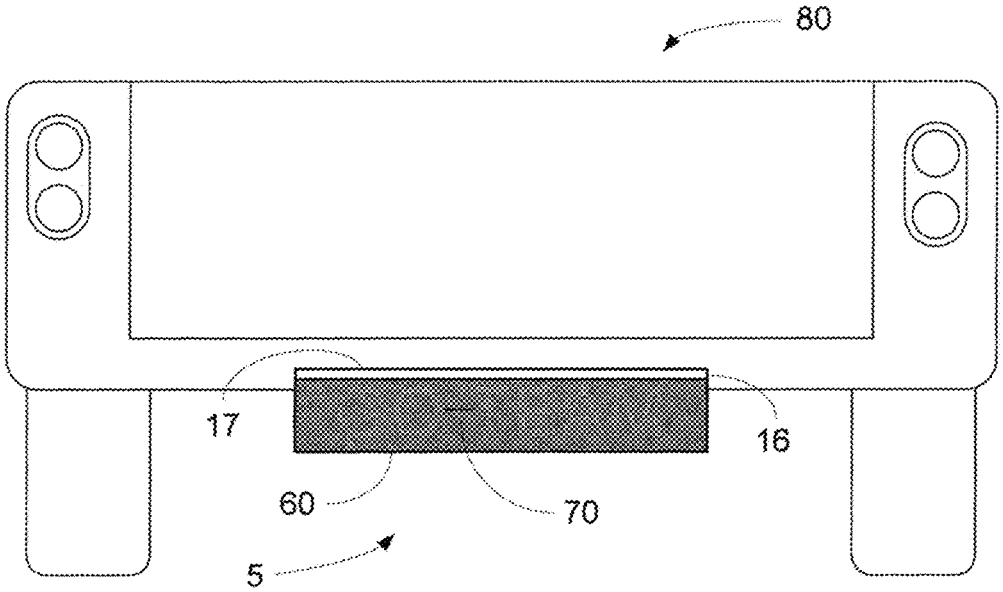
FIG. 5B is a rear view of a vehicle showing installation of a message board with message mask material applied.

As depicted in FIG. 5A, the base member 10 of the lighting display device 5 is positioned upon the rear of the vehicle 80 with the hitch mount engaging the vehicle hitch receiver. The trailer wiring plug 50 is engaged with and receives electrical signals from the vehicle trailer wiring connector. Also shown are lighting elements in the form of light bulbs 34 extending into the C cross-section of base member 10. As depicted in FIG. 5B, the message board 70 is slid into position within the base member. In this orientation, the message cut into the mask material 70 is readily viewable from the rear of the vehicle by other drivers. The step plate 16 extends out from the base member 10 with the upper surface 17 providing a convenient step for operator access to the upper rear of the vehicle.

The message board 60 is secured within the base member 10 using plastic end-caps which snap into and engage the C cross-section of the base member. The message board 60 may be readily replaced with another message by simply removing the end-cap and replacing the message board. For example, a vehicle may be used in a personal business during the week and the vehicle owner may display a business advertisement with phone number, for example "LAWN CARE: 404-1234" On the weekend, the vehicle owner may choose to display another message board for college game day, or race day. The simple positioning and replacement of the message boards allow the vehicle owner to express his personal style on a daily basis. The message boards may also be retained within the base member by clips, fasteners, pins, adhesives, or other means as are known to those skilled in the art.

Figure 6A:
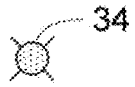
FIGS. 6A, 6B are graphical depictions of lighting elements illuminated at a low-light intensity level and a high-light intensity level respectively.
Figure 6B:
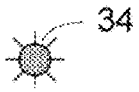

As depicted in FIGS. 6A and 6B, the light elements used within the device may produce a low intensity light, or a high intensity light when illuminated. The light bulbs 34 may produce a low intensity light as graphically depicted in FIG. 6A, or may produce a high intensity light as graphically depicted in FIG. 6B. Such lighting elements are commonly referred to as 3-way bulbs in the automotive industry and are readily available.

Figure 7A:
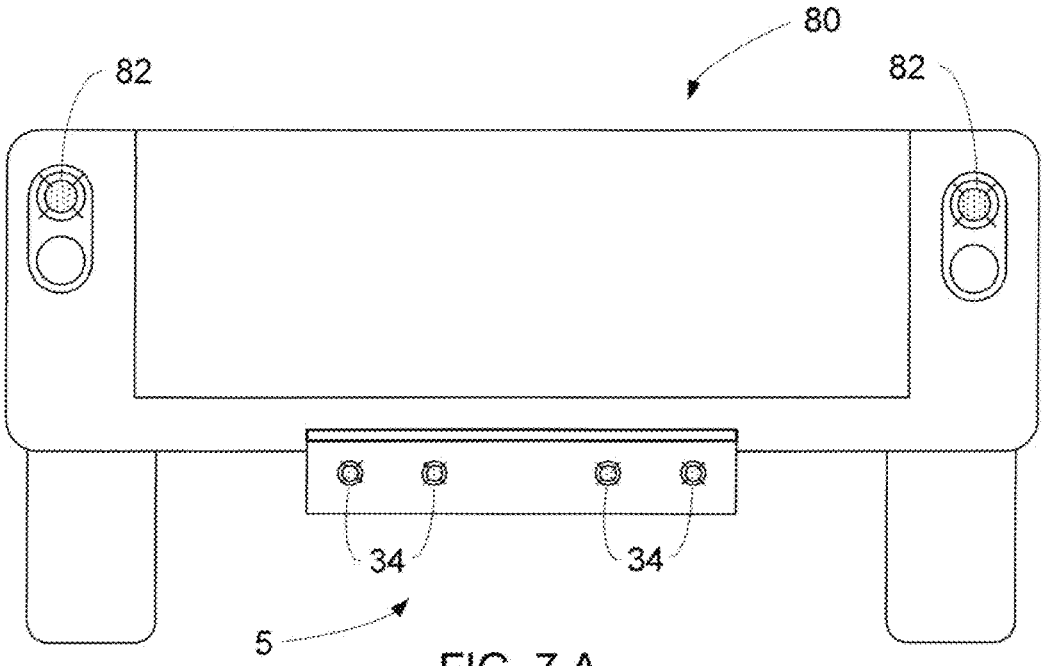
FIG. 7A is a rear view of a vehicle showing low-light intensity illumination of the vehicle tail lights and a low-light intensity level of the lighting elements of the device.
Figure 7B:
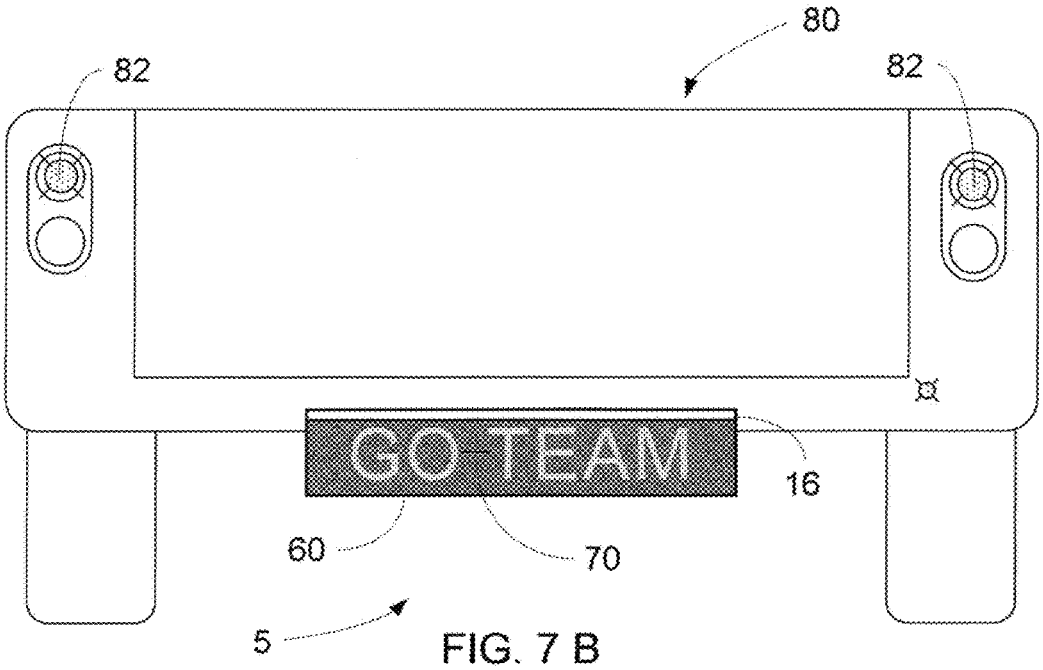
FIG. 7B is a rear view of a vehicle showing a low-light intensity level illumination of the device message board.

As depicted in FIG. 7A, the vehicle driving tail-lights 82 are depicted illuminated at a low-intensity level. Such may be the case when the vehicle headlights are on at night or for vehicles equipped with daytime running lights. The light bulbs 34 of the lighted display device 5 are shown illuminated at a low intensity. As depicted in FIG. 7B, the low intensity level illuminated light bulbs 34 backlight the message board 60 and clearly display the desired lighted message 70. This would be the normal driving appearance of the lighted display.

Figure 8A:
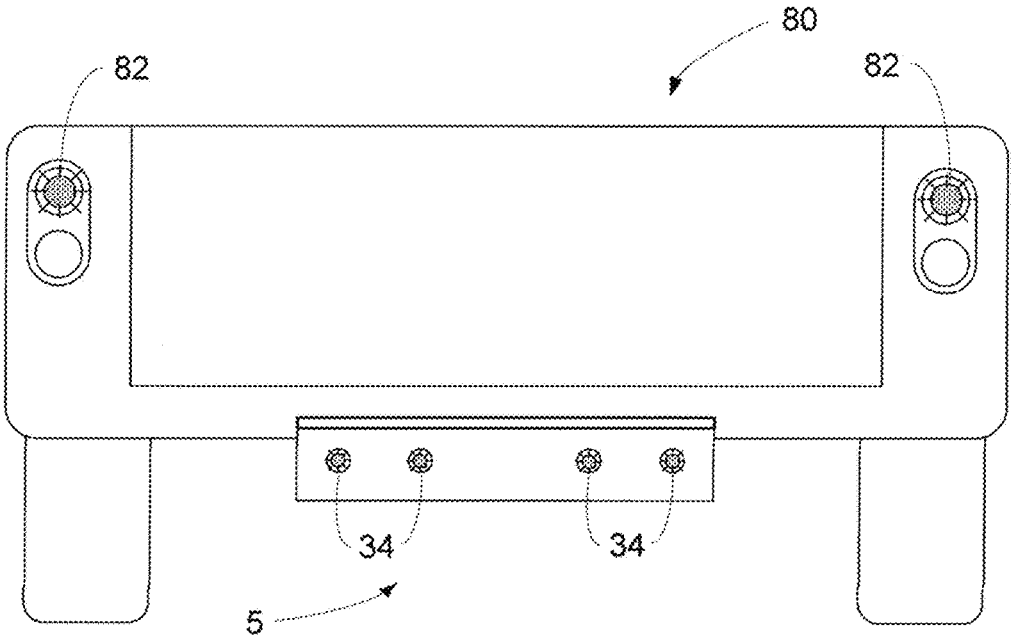
FIG. 8A is a rear view of a vehicle showing high-light intensity illumination of the vehicle brake lights and a high-light intensity level of the lighting elements of the device.
Figure 8B:
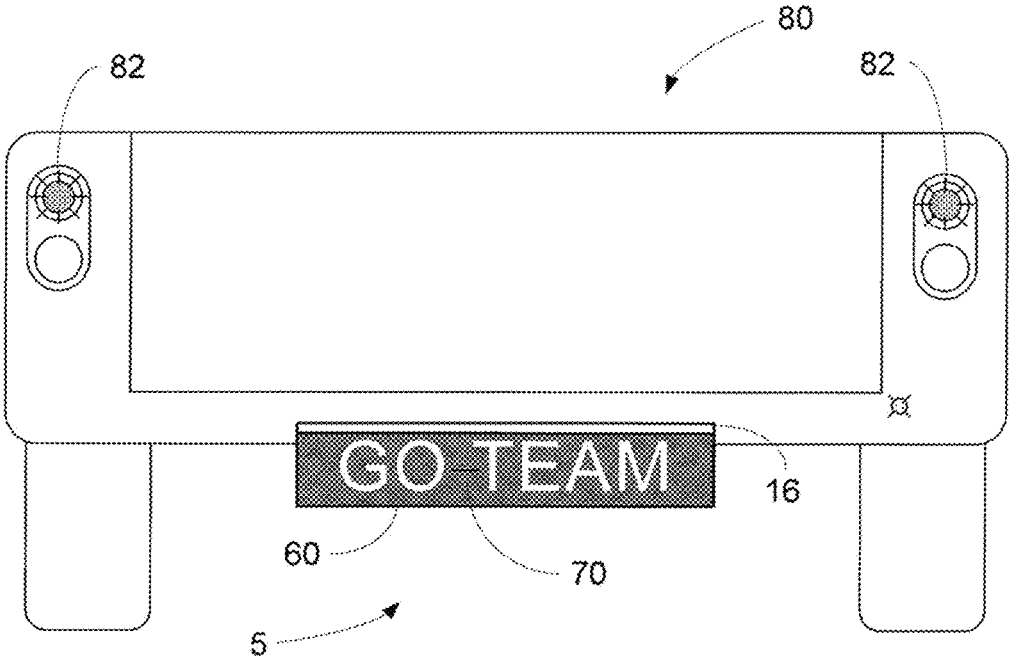
FIG. 8B is a rear view of a vehicle showing a high-light intensity level illumination of the device message board.

As depicted in FIG. 8A, the vehicle is braking and the tail-lights 82 are depicted illuminated at a high intensity level. The light bulbs 34 of the lighted display device 5 are then illuminated at a high intensity level. As depicted in FIG. 8B, the high-intensity level illuminated light bulbs 34 backlight the message board 60 and more brightly display the desired lighted message 70. The increased intensity light from the message board 60 provides valuable additional notice to other drivers that the vehicle is braking.

Figure 9A:
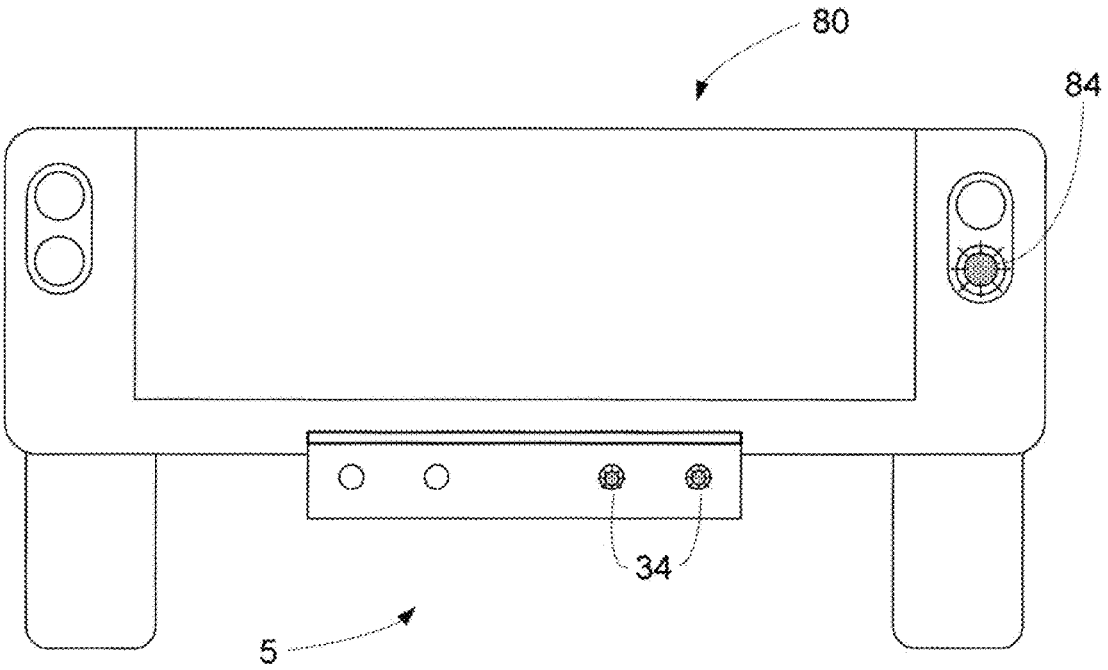
FIG. 9A is a rear view of a vehicle showing high-light intensity illumination of the vehicle right turn signal and a high-light intensity level of the right side lighting elements of the device.
Figure 9B:
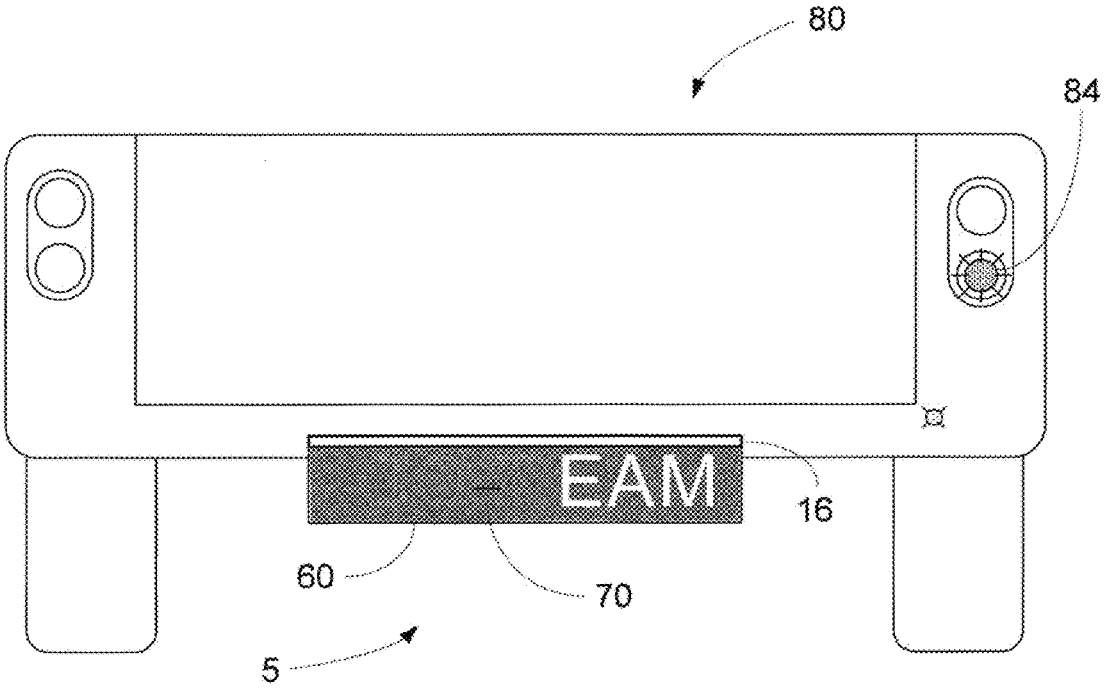
FIG. 9B is a rear view of a vehicle showing a high-light intensity level illumination of the right side of the device message board.

As depicted in FIG. 9A, the vehicle is making a right turn signal and the right turn signal marker light 84 is depicted illuminated at a high-intensity level. The light bulbs 34 on the right side of the lighted display device 5 are then illuminated at a high intensity level. As depicted in FIG. 9B, the high-intensity level illuminated light bulbs 34 backlight the message board 60 and more brightly display on the right side of the device 5. The increased intensity light from the right side of the message board 60 again provides valuable additional notice to other drivers that the vehicle is turning right.

Figure 10A:
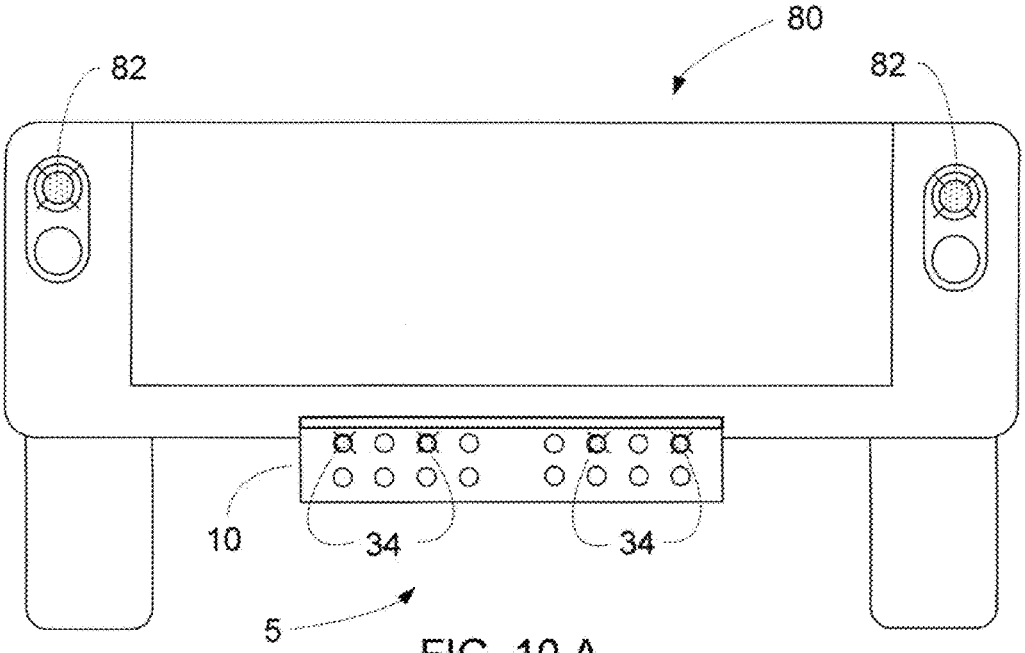
FIG. 10A is a rear view of a vehicle showing low-light intensity illumination of the vehicle tail lights and an alternative illumination of a portion of the device lighting elements.
Figure 10B:
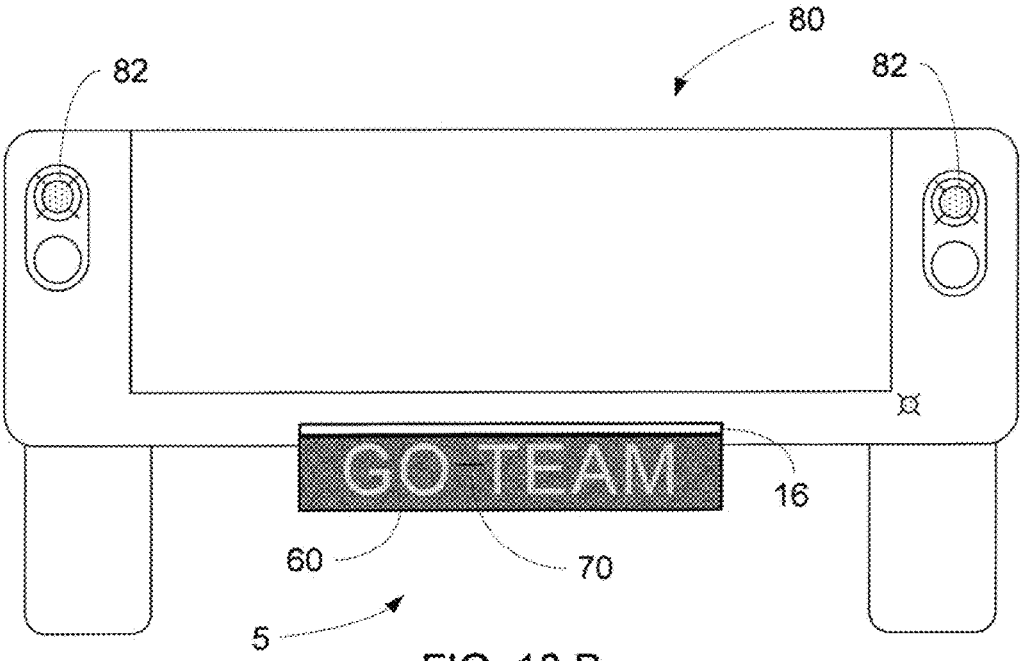
FIG. 10B is a rear view of a vehicle showing a low-light intensity level illumination of the device message board.

As depicted in FIGS. 10A-10B, 11A-11B, and 12A-12B, in an alternative embodiment of the present invention, the lighting elements may only have a single light intensity level. In this embodiment, the lighted display device 5 has multiple light bulbs 34 positioned across the face of the base member 10. As depicted in FIG. 10A the vehicle driving tail-lights 82 are depicted illuminated at a low-intensity level. A portion of the light bulbs 34 of the lighted display device 5 are illuminated, thus producing a low intensity light level. As depicted in FIG. 10B, the low-intensity level light backlights the message board 60 and displays the desired lighted message 70. This would be the normal driving appearance of the lighted display.

Figure 11A:
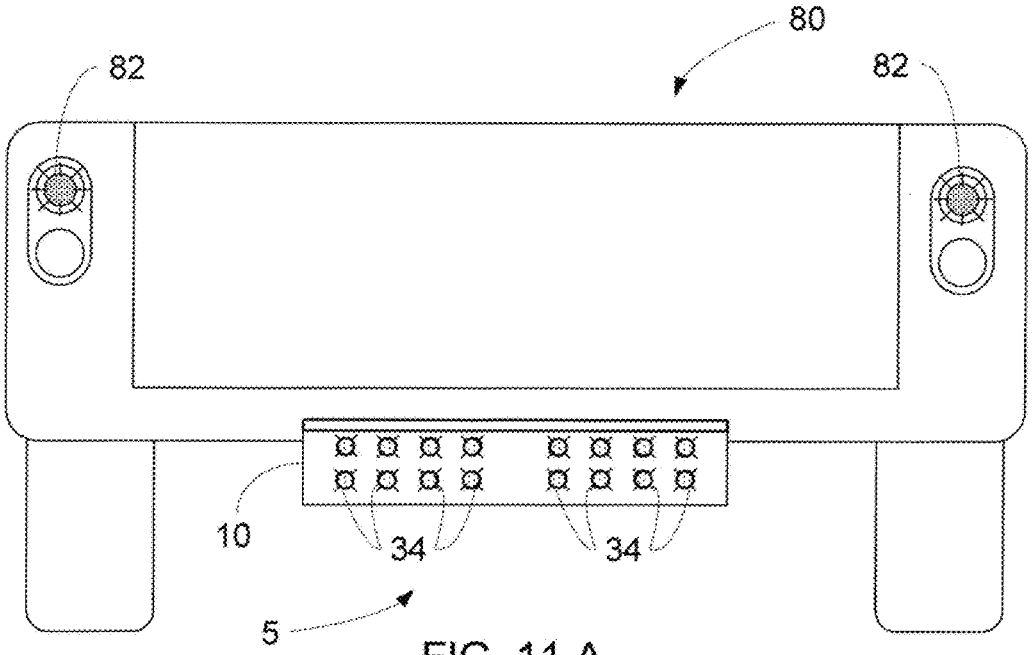
FIG. 11A is a rear view of a vehicle showing high-light intensity illumination of the vehicle brake lights and an alternative illumination of all of the device lighting elements.
Figure 11B:
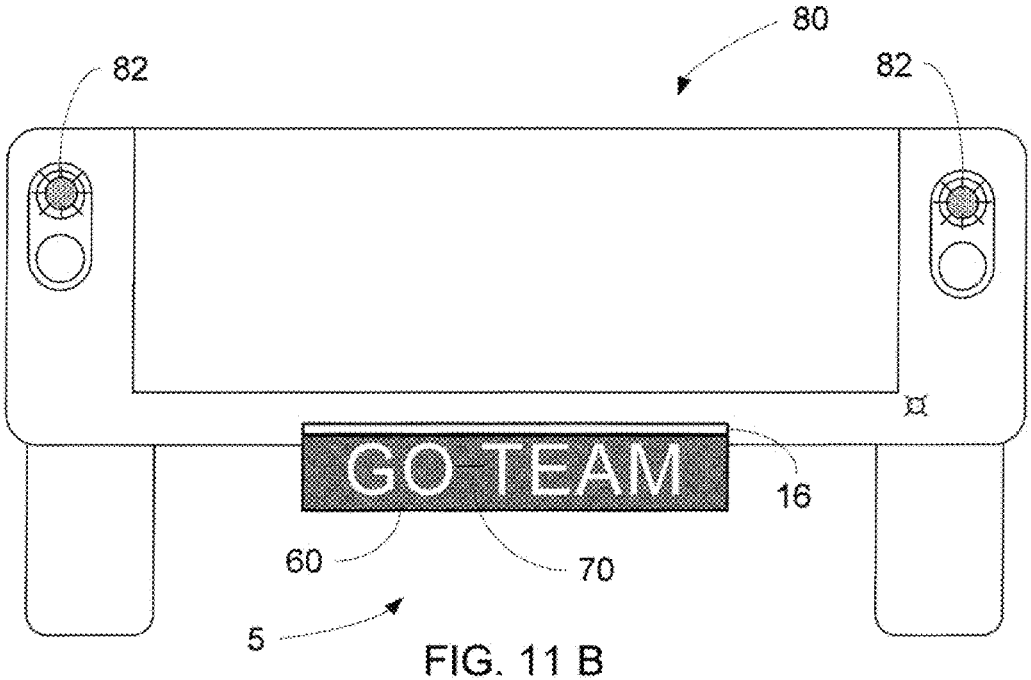
FIG. 11B is a rear view of a vehicle showing a high-light intensity level illumination of the device message board.

As depicted in FIG. 11A, the vehicle is braking and the tail-lights 82 are depicted illuminated at a high-intensity level. All the light bulbs 34 of the lighted display device 5 are then illuminated, thus producing a high intensity light. As depicted in FIG. 11B, the high-intensity light backlights the message board 60 and more brightly displays the desired lighted message 70. The increased intensity light from the message board 60 again provides valuable additional notice to other drivers that the vehicle is braking.

Figure 12A:
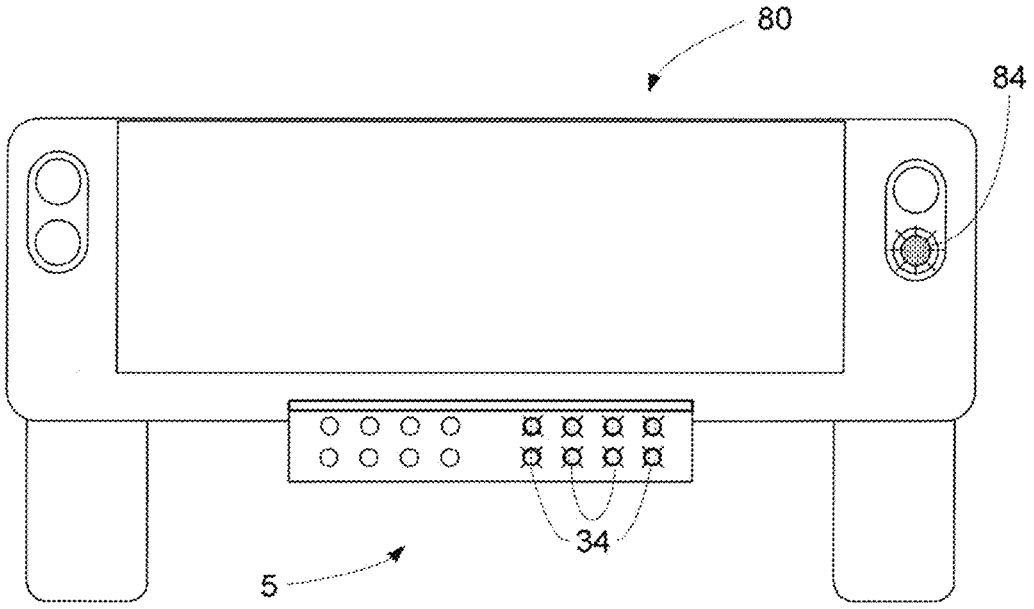
FIG. 12A is a rear view of a vehicle showing high-light intensity illumination of the vehicle right turn signal and an alternative illumination of all of the right side device lighting elements.
Figure 12B:
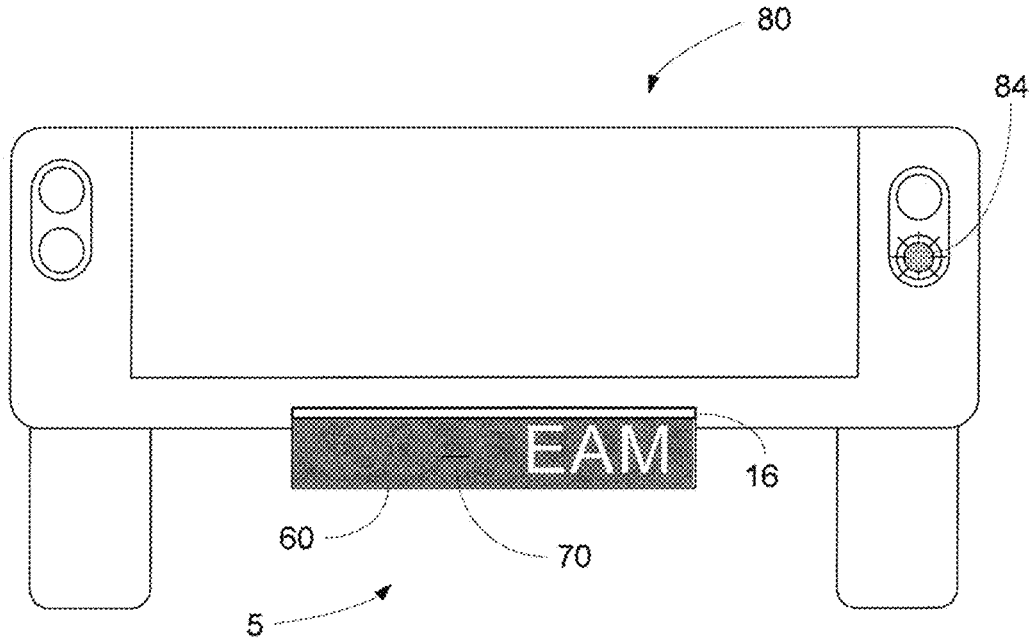
FIG. 12B is a rear view of a vehicle showing a high-light intensity level illumination of the right side of the device message board.

As depicted in FIG. 12A, the vehicle is making a right turn signal and the right turn signal marker light 84 is depicted illuminated at a high-intensity level. All the light bulbs 34 on the right side of the lighted display device 5 are then illuminated. As depicted in FIG. 12B, the right side illuminated light bulbs 34 backlight the message board 60 and more brightly display the right side of the device 5. The increased intensity light from the right side of the message board 60 again provides valuable additional notice to other drivers that the vehicle is turning right.

Figure 13A:
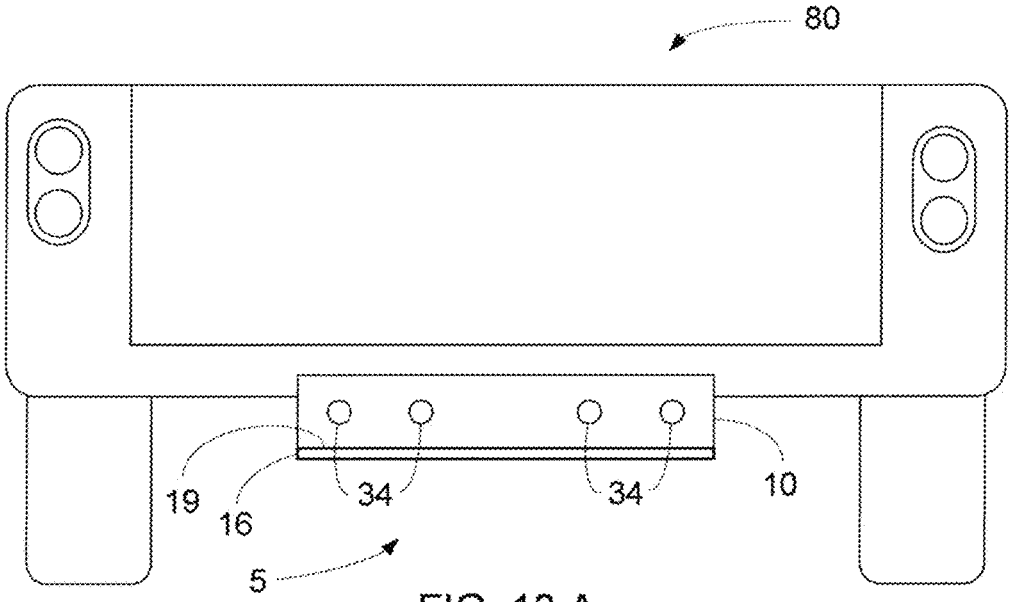
FIG. 13A is a rear view of a vehicle showing an alternative orientation for installation of the base member and lighting elements of the device upon the vehicle.
Figure 13B:
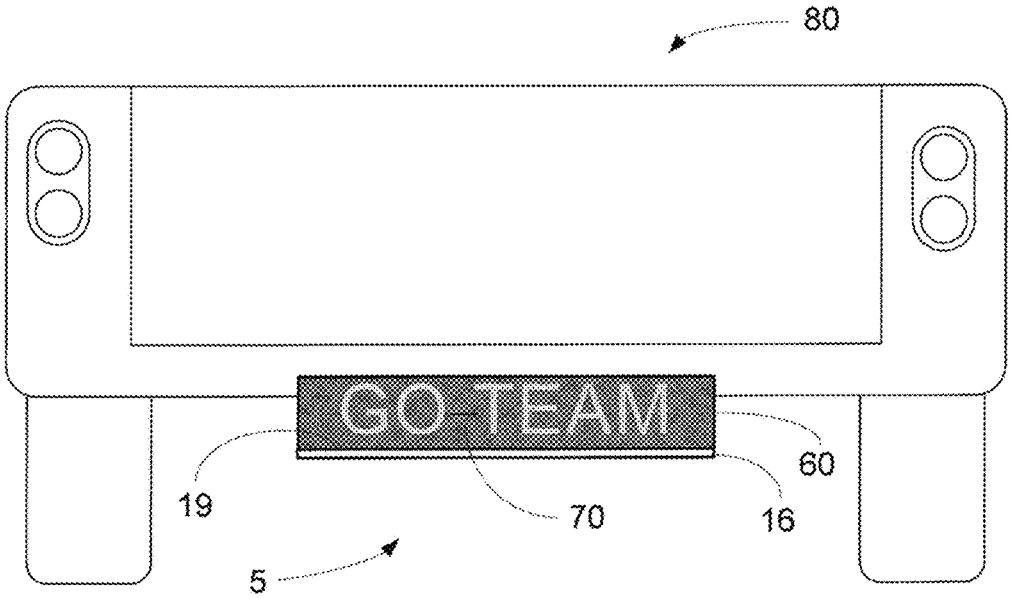
FIG. 13B is a rear view of a vehicle showing an alternative orientation of the message board with message mask material applied.

An alternative configuration of the installation of the lighted display device upon a vehicle is presented in FIGS. 13A and 13B. The trailer hitch receiver and device hitch mount are both square in cross-section. In this configuration the base member 10 is installed inverted upon the vehicle with the device hitch mount inverted within the vehicle hitch receiver. In this orientation, the step plate section 16 is positioned at the bottom of the lighted display assembly and physically lower on the vehicle structure. The lighting elements 34 are then repositioned within the base member 10 to ensure that the right and left turn signal illuminations appear on the proper side of the vehicle in coordination with the vehicle lighting system. The surface 19 of the step plate section 16 also has ribs or serrations to provide a non-skid surface for the user in this orientation. As depicted in FIG. 13B, the message board 60 may be easily positioned within the base member 10 such that the message appears correctly to the viewer. The high-step configuration of FIGS. 7-12 may be useful in vehicles with high ground clearance and/or high loading decks such as full size pick-up trucks. The low-step configuration of FIG. 13 may be more useful in smaller sport-utility or passenger vehicles. The high-step or low-step configuration is easily selected by the vehicle owner upon installation of the lighted display device.

While there has been shown a preferred embodiment of the present invention, it is to be understood that certain changes may be made in the forms and arrangement of the elements and steps of the method for the trailer hitch lighted display device without departing from the underlying spirit and scope of the invention.

What is claimed is:

1. A lighted display for use upon a vehicle, the vehicle having at least one driving light at the front of the vehicle, at least one brake light at the rear of the vehicle, and at least one turn signal light on each side of the rear of the vehicle, the vehicle also having a trailer hitch receiver for receiving a trailer hitch mount therein, and a trailer electrical wiring connector for receiving a trailer wiring plug therein, the lighted display comprising:

an elongated base member having:

a rear wall;

a substantially horizontal top wall connected to the rear wall at an angle thereto and comprising:

an upper surface with a length and a width to define a flat step area having a size sufficient to receive a substantial portion of a human foot to present safe footing for a person attempting to access the vehicle; and a lower surface opposite the upper surface;

a bottom wall connected to the rear wall at an angle thereto, the top, rear, and bottom walls defining an internal chamber;

a trailer hitch mount affixed at a midway point of the rear surface of the base member and shaped to be received and secure within the trailer hitch receiver such that, when secured therein:

in a first position, where the horizontal top wall forms an upper step for access to the vehicle at a given level, the base member and the trailer hitch mount bear the weight of the person when stepping upon the upper surface; and in a second position opposite the first position, where the horizontal top wall is upside-down, the lower surface forms a lower step at a step level lower than the given level and the base member and the trailer hitch mount bear the weight of the person when stepping upon the lower surface;

a trailer wiring plug;

a plurality of lighting elements configured to be received within the rear surface of the base member, the lighting elements in electrical contact with the trailer wiring plug, each of the plurality of lighting elements configured to be illuminated at a high light intensity level and a low light intensity level;

a message board configured to be removably secured within the internal chamber of the base member, the message board comprising a semi-translucent material; and wherein portions of the message board are substantially opaque to form a desired message for display.

2. The lighted display of claim 1, wherein;

the hitch mount is received within the hitch receiver of the vehicle;

the wiring plug is inserted within the vehicle wiring connector; and upon illumination of the vehicle driving light, at least one of the lighting elements is illuminated at the low light intensity level.

3. The lighted display of claim 2, wherein all the lighting elements are illuminated at the low light intensity level.

4. The lighted display of claim 1, wherein:

the hitch mount is received within the hitch receiver of the vehicle;

the wiring plug is inserted within the vehicle wiring connector; and upon illumination of the vehicle brake light, at least one of the lighting elements is illuminated at the high light intensity level.

5. The lighted display of claim 4, wherein all of the plurality of lighting elements are illuminated at the high light intensity level.

6. The lighted display of claim 1, wherein:

the hitch mount is received within the hitch receiver of the vehicle;

the wiring plug is inserted within the vehicle wiring connector; and upon illumination of the vehicle turn signal light, at least one of the lighting elements is illuminated at the high light intensity level in coordination with and on the corresponding side of the vehicle as the vehicle turn signal light.

7. The lighted display of claim 1, wherein the upper surface of the top wall has serrations and/or ribs.

8. The lighted display of claim 1, wherein the substantially opaque portions define a stylized design visible from outside the vehicle.

9. The lighted display of claim 1, wherein:

the hitch mount is received within the hitch receiver of the vehicle;

the wiring plug is inserted within the vehicle wiring connector; and upon illumination of the vehicle driving light, at least one of the lighting elements is illuminated.

10. The lighted display of claim 1, wherein:

the hitch mount is received within the hitch receiver of the vehicle;

the wiring plug is inserted within the vehicle wiring connector; and upon illumination of the vehicle brake light, at least one of the lighting elements is illuminated.

11. The lighted display of claim 10, wherein at least one of the lighting elements is illuminated at a left side of the base member and at least one of the lighting elements is illuminated at a right side of the base member.

12. The lighted display of claim 1, wherein;

the hitch mount is received within the hitch receiver of the vehicle;

the wiring plug is inserted within the vehicle wiring connector; and upon illumination of the vehicle turn signal light, at least one of the lighting elements is illuminated in coordination with and on the corresponding side of the vehicle as the vehicle turn signal light.

13. The lighted display of claim 1, wherein the base member comprises an aluminum extrusion.

14. The lighted display of claim 1, wherein the substantially opaque portions are of material covering the message board comprising a shape of an alphabetical or numerical letter or a stylized design.

15. The lighted display of claim 13, wherein the rear wall, the horizontal top wall, and the bottom wall form a substantially C-shape.

* * * * *